United States Patent [19]

Ploppa

[11] Patent Number: 4,486,623

[45] Date of Patent: Dec. 4, 1984

[54] HIGH-FLEX INSULATED ELECTRICAL CABLE

[75] Inventor: Jürgen Ploppa, Pfullingen, Fed. Rep. of Germany

[73] Assignee: H. Stoll GmbH and Company, Fed. Rep. of Germany

[21] Appl. No.: 429,900

[22] Filed: Sep. 30, 1982

[30] Foreign Application Priority Data

Dec. 17, 1981 [DE] Fed. Rep. of Germany ..... 3150031

[51] Int. Cl.[3] ..... H01B 7/04

[52] U.S. Cl. ..... 174/113 R; 174/110 V; 174/113 C; 174/116

[58] Field of Search ..... 174/113 R, 113 C, 113 A, 174/116, 110 V

[56] References Cited

U.S. PATENT DOCUMENTS

| | | | |
|---|---|---|---|
| 2,014,214 | 9/1935 | Smith | 174/113 R |
| 2,413,673 | 12/1946 | Sears | 174/110 V |
| 2,718,544 | 9/1955 | Shepp | 174/113 R |
| 2,856,453 | 10/1958 | Shepp | 174/116 |
| 3,209,064 | 9/1965 | Cutler | 174/113 R |
| 3,710,006 | 1/1973 | Davis | 174/113 C X |
| 3,710,007 | 1/1973 | Hoeg et al. | 174/113 R X |
| 3,857,996 | 12/1974 | Hansen et al. | 174/113 R |
| 4,125,741 | 11/1978 | Wahl et al. | 174/113 A |

FOREIGN PATENT DOCUMENTS

| | | | |
|---|---|---|---|
| 1465777 | 7/1971 | Fed. Rep. of Germany . | |
| 505371 | 12/1954 | Italy | 174/116 |

*Primary Examiner*—A. C. Prescott
*Assistant Examiner*—Morris H. Nimmo
*Attorney, Agent, or Firm*—Jones, Tullar & Cooper

[57] ABSTRACT

Described is a high-flex insulated electrical cable (11) for the carriages of flat knitting machines, this cable having two concentric multi-strand twisted layers (12, 13) each of which is comprised of a plurality of insulated individual strands (17) laid in long lay at the same twist angle.

To enable a cable (11) of this nature to resist torsional stresses to an increased degree while retaining its shape and also to give it an extended length of life despite such torsional stresses, the individual strands (17) of each layer (12, 13) have an outer peripheral layer of resiliently deformable soft plastic (18, 19) injected therearound which penetrates into the gussets (22) which are formed between the individual strands (17).

12 Claims, 3 Drawing Figures

HIGH-FLEX INSULATED ELECTRICAL CABLE

BACKGROUND OF THE INVENTION

1. Field of the Invention

The present invention relates to a high-flex insulated electrical cable, and in particular to such a cable having a plurality of multi-strand layers arranged in superposed or side-by-side condition and disposed in long lay at the same angle of twist.

2. Prior Art

For example, in the case of flat knitting machines in which the needle selection is effected electronically problems are encountered in relation to the electrical cable which is fixedly anchored at one end midway along the machine frame and at the other end to a recriprocating carriage. During reciprocation of the carriage the cable is not only bent but also twisted. In particular it has been found that the resulting torsional stress is more damaging to the cable than the simple bending stress, even more so in a knitting machine arrangement than in other technical arrangements, for example the arrangements found in traction or conveyor plants.

Electrical cables having concentric layers of strands laid in reverse with one another are known. This arrangement is of great disadvantage not only for withstanding the bending stresses but also the torsional stresses to which the cable is subjected. This is so because in the case of torsional stressing the strands of one layer are twisted together and those of the other apart, i.e., are respectively compressed and stretched. Counter twisting is therefore necessary in such cables if they are to retain their shape.

In cables of this nature, which are exposed to bending stresses, it has been proposed to dispose the concentric layers of strands in long-lay (see for example, German laid open application No. 1,465,777), an attempt being made to keep the cable in shape by winding the banding between the layers with a reverse twist. In the case of cables which are subject to bending stresses only, this may be of some advantage in relation to the counterlaying of the layers despite the reverse twisting of the banding. This does not apply, however, to cables which are exposed to torsional stresses in addition to, or in place of, the bending stresses. Thus, where there is reversed-direction banding of this kind, torsioning of the cable leads to shifting of the strand layers relatively to the banding, leading to damage of the insulation of the individual strands and possibly even to breakage of the cable or of individual strands. In the case, for example, of knitting machines which are in operation continuously, the frequency of the reciprocating movement of the carriage is very high, for instance in the range of some 10 passes per minute, and this must be accounted for in addition to the above noted considerations.

OBJECT AND SUMMARY OF THE INVENTION

Thus it is a principal object of the present invention to provide a high-flex insulated electrical cable of the kind noted above which, while retaining its shape, can resist even torsional stresses to a high degree and, under conditions of such torsional stressing, has an extended length of life.

This object is achieved in a high-flex insulated electrical cable comprising: a plurality of multi-strand layers laid in rope style and arranged in superposed or side-by-side condition and disposed in long-lay at the same angle of twist, each such layer having a plurality of twisted insulated individual strands; and a resiliently deformable soft plastic injection coating for each layer which covers the strands of that layer and extends into the gusset area defined between adjacent individual strands of that layer.

Thus in the present invention the individual strands of each strand layer are coated by pressure-injection from the exterior with a resiliently-deformable soft plastic in such a way as to be embedded simultaneously in an open-topped half-shell of this plastic and thereby held in position. As a result, and since the plastic is soft enough, a structure or cable results which is homogeneous as regards stretch and in which no relative shifting of the strand layers and intermediate layers is possible, the cable thus retaining its shape. Experience has shown that a high-flex insulated electrical cable of this nature is stable against torsional stresses and therefore, despite this stressing is of long life. A soft P V C plastic is preferred for the plastic-injection.

According to one embodiment of the present invention the individual strand layers are arranged concentrically, with the individual strands of each layer being in each case given the plastic coating from the exterior, and with the inner periphery of the next following layer bearing directly against the outer periphery of this plastic coating. Where appropriate a circular section core can be provided within the innermost strand layer, in which event it can again be of a resiliently-deformable soft plastic, preferably a P V C plastic.

According to another embodiment of the present invention a plurality of strand layers are disposed side-by-side and one over another, these layers being in each case provided with the injected plastic coating and, depending on the radius on which they lie, provided in long lay with the same twist. This embodiment has the advantage that all the strand layers are disposed on the same radius.

Preferably the insulation of the individual strands of the layers is covered with a lubricant to enable the individual strands to move back and forth easily within the plastic jacket provided for the cable.

Further features of the invention will become evident from the following description of the preferred embodiments illustrated in the accompanying drawings in which:

DESCRIPTION OF THE PREFERRED EMBODIMENT

A high-flex insulated electrical cable 11, 11' and 11'' respectively, illustrated in the accompanying drawings is so formed and arranged as to resist stresses, and in particular torsional stresses, which occur when one end of the cable is held anchored and the other is fastened to a carriage or the like which reciprocates in two directions of movement. The cable 11, 11' and 11'', respectively, is composed of a plurality of multi-strand layers 12, 13; 12', 13'; and 12", 14, 15 and 16, respectively. These layers are either concentric or disposed side-by-side and one above another, and are twisted in long lay.

Figure 1:
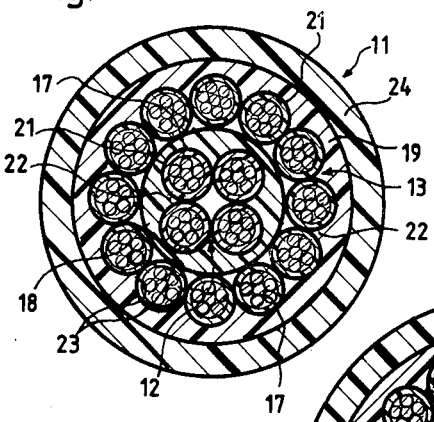
FIG. 1 is a cross section through a high-flex insulated electrical cable with two concentric multi-strand rope-type layers in accordance with a first embodiment of the invention.

In the case of cable 11 of FIG. 1 there are two concentric multi-strand layers 12 and 13 of which the layer 12 is composed of four individual strands 17 which are arranged side-by-side and superimposed. The other layer 13 is composed of twelve individual strands 17 which are arranged side-by-side on a specific radius. The individual strands 17 are made up, in a known fashion, of a plurality of inter-twisted thin copper wires coated in an insulation of plastic sleeving.

Each multi-strand layer 12 and 13 is provided with an injected plastic coating, 18 and 19, respectively. The coatings 18 and 19 are made of a resiliently-deformable, soft P V C plastic. The coating 18 and 19 of the individual strands 17, is injected under pressure separately for each layer 12 and 13 and from the exterior of the layer so as to provide that the injected plastic is applied to an area 21 defined by each strand between the contact areas of two adjacent individual strands. In other words, the outer peripheral area 21 of each individual strand 17 is coated, with the coating penetrating into a gusset region 22 defined between these individual strands. As a consequence the individual strands 17 of each layer 12 and 13 are embedded in a half-shell setting 23 which follows the twist of the layer. This holds the individual strands 17 of each multi-strand layer 12 and 13 in their orientation or position so that the cable 11 will retain its shape despite any kind of applied stress.

The thickness of the inner injection coating 18 depends primarily on the diameter of the next following layer 13 because the individual strands 17 of the next following concentric layer 13 bear directly at its inner periphery against the outer periphery of the injection layer 18 of the inner multi-strand layar 12. The fact that the plastic used for the injection coated layers 18 and 19 is readily elastically deformable and soft provides a substantially homogeneous status for the cable 11. Before the individual strands 17 are embedded in the injected plastic coating 18 and 19 they are covered along the outer periphery of their insulation with a lubricant medium so that they can be moved without difficulty along and within their plastic coating 18 and 19.

Since the individual strands 17 are disposed in long lay and twisted at the same pitch angle within each strand layer 12 and 13, the length of lay will differ depending on the radius at which they are disposed, being shorter internally than externally, which means that during torsional stress the individual strands of the outer layer 13 can be more heavily stressed than those of the inner layer 12.

The cable 11 is enclosed in a jacket 24, for example of polyurethane, disposed over the outer layer 13 or its plastic injected coating 19 as protection against outer effects, for example rubbing or the like.

Figure 2:
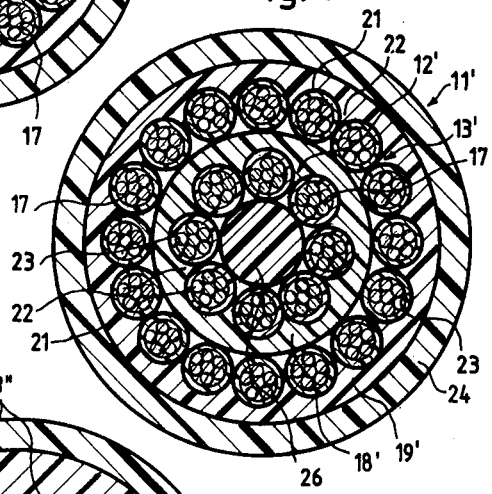
FIG. 2 is a cable similar to that of FIG. 1 but showing a second embodiment of the invention.

In the embodiment of FIG. 2 the cable 11' is similar in major respects to the cable 11 of FIG. 1, the only difference being that the inner multi-strand layer 12' is made up of eight individual strands 17 and the outer layer 13' of seventeen strands 17. The fact that the inner layer 12' is composed of strands 17 set side-by-side over a chosen diameter defines a core 26 along the longitudinal axis directly enclosed by the individual strands 17 of the layer 12'. The core 26 is formed, as are the layers 18', 19' from the previously-mentioned readily resilient soft P V C plastic. The remaining features are the same.

Figure 3:
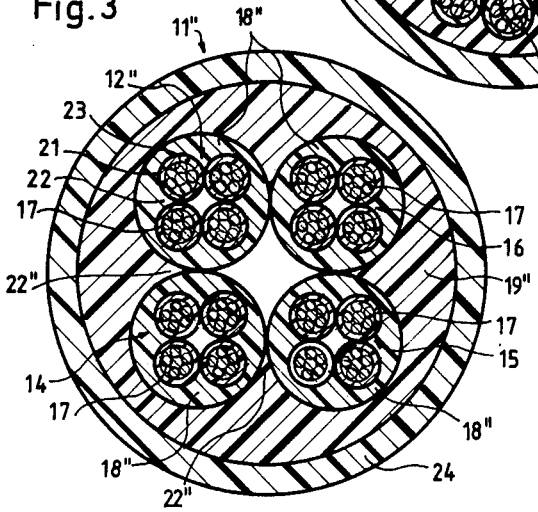
FIG. 3 is a cross section through a high-flex insulated cable with four side-by-side multi-strand layers in accordance with a third embodiment of the invention.

The cable 11" in the embodiment of FIG. 3 comprises four side-by-side and superimposed multi-strand layers 12", 14, 15 and 16, which are individually composed, as is the inner layer 12 of the embodiment of FIG. 1, of four side-by-side and superimposed individual strands 17. In this embodiment all four strand layers 12", 14, 15 and 16 are of identical construction. As in the first embodiment of FIG. 1 they are provided with an injected plastic layer 18". The four strand layers 12", 14, 15 and 16, like the individual strands 17, are twisted together within each layer of strands, and in long lay with the individual strands 17 of each multi-strand layer and at the same angle of twist, as is the case in each layer itself.

The individual strand layers 12", 14, 15, 16 which are in contact with one another at their smooth outer periphery of their plastic layer 18", are covered with an injected plastic layer 19" which penetrates into the gusset 22" between adjacent layers. The covering 19" is surrounded by a protective jacket 24".

The advantage of this construction as regards the stressing of the cable lies in the fact that all four layers 12", 14, 15, 16 are disposed on a circular radius. For the rest they display the same features as in the embodiments previously described.

The described embodiments are composed either of two concentric multi-strand layers or four side-by-side layers within one cable. It will be understood that in the present invention the number of the strand layers which can lie within one cable 11 can be any number required.

What is claimed is:

1. A high-flex insulated electrical cable, comprising:

a plurality of multi-strand layers, arranged concentric with one another, disposed in long lay at the same angle of twist, each layer having a plurality of twisted strands arranged adjacent to one another, with each said strand defining an outer peripheral area and with adjacent said strands defining a gusset region between them, and a resiliently deformable soft plastic injection coating for each layer, each said coating extending over the outer peripheral areas into the gusset regions defined by the strands of its respective said layer, said resiliently deformable soft plastic coatings being sufficiently resiliently deformable so as not to obstruct the extension or compression of the cable during torsional stressing thereof.

2. The high-flex insulated electrical cable as defined in claim 1, further comprising:

a plastic core of circular cross section surrounded by the innermost layer of said plurality of multi-strand layers.

3. The high-flex insulated electrical cable as defined in claim 2, wherein the core comprises soft P V C.

4. The high-flex insulated electrical cable as defined in claim 1, wherein one of the plurality of multi-strand layers are arranged in side-by-side condition.

5. The high-flex insulated electrical cable as defined in claim 4, wherein the plurality of multi-strand layers are arranged over one another and laid in long lay beneath one another in each layer.

6. The high-flex insulated electrical cable as defined in claim 1, further comprising:

a plastic core of circular cross section surrounded by the plurality of multi-strand layers.

7. The high-flex insulated electrical cable as defined in claim 6, wherein the core comprises soft P V C.

8. The high-flex insulated electrical cable as defined in claim 1, wherein the coatings comprises a soft P V C.

9. The high-flex insulated electrical cable as defined in claim 1, wherein the resiliently deformable soft plastic coatings are applied under pressure.

10. The high-flex insulated electrical cable as defined in claim 1, further comprising:

a lubricant medium coated onto the insulated

11. The high-flex insulated electrical cable as defined in claim 1, further comprising: a plastic jacket surrounding the cable.

12. The high-flex insulated electrical cable as defined in claim 11, wherein the plastic jacket comprises polyurethane.

* * * * *